US011744319B2

(12) United States Patent
Farina

(10) Patent No.: US 11,744,319 B2
(45) Date of Patent: Sep. 5, 2023

(54) FOOTWEAR HEEL INSERT

(71) Applicant: Walmart Apollo, LLC, Bentonville, AR (US)

(72) Inventor: Salvo Farina, Cave Springs, AR (US)

(73) Assignee: Walmart Apollo, LLC, Bentonville, AR (US)

( * ) Notice: Subject to any disclaimer, the term of this patent is extended or adjusted under 35 U.S.C. 154(b) by 10 days.

(21) Appl. No.: 17/386,273

(22) Filed: Jul. 27, 2021

(65) Prior Publication Data

US 2023/0030734 A1 Feb. 2, 2023

(51) Int. Cl.
*A43B 7/144* (2022.01)
*A43B 11/00* (2006.01)

(52) U.S. Cl.
CPC ..... *A43B 7/144* (2013.01); *A43B 11/00* (2013.01)

(58) Field of Classification Search
CPC ..... A43B 11/00; A43B 3/248; A43B 7/144
See application file for complete search history.

(56) References Cited

U.S. PATENT DOCUMENTS

| | | | | |
|---|---|---|---|---|
| 4,103,440 | A | 8/1978 | Lawrence | |
| 5,189,814 | A | 3/1993 | Barma | |
| 10,638,810 | B1 * | 5/2020 | Cheney | A43B 3/00 |
| 10,905,192 | B1 * | 2/2021 | Cheney | A43B 23/027 |
| 2002/0174567 | A1 | 11/2002 | Krafsur et al. | |
| 2005/0126044 | A1 | 6/2005 | Langley | |
| 2011/0271556 | A1 | 11/2011 | Dillenbeck | |
| 2012/0317839 | A1 * | 12/2012 | Pratt | A43B 11/00 36/105 |

(Continued)

FOREIGN PATENT DOCUMENTS

| | | | |
|---|---|---|---|
| EP | 0096542 | A1 | 3/1993 |
| EP | 1059044 | A1 | 12/2000 |

(Continued)

OTHER PUBLICATIONS

Unknown, "ShoePassion", The Wayback Machine—htt ps://web.archive.org/web/20210304223232/htt ps://www.shoepassion.com/shoe-encyclopaedia/shoe-construction/, captures Jul. 6, 2021, 3 pages.

(Continued)

*Primary Examiner* — Ted Kavanaugh
(74) *Attorney, Agent, or Firm* — Barta, Jones & Foley, PLLC

(57) ABSTRACT

A heel insert is provided for an article of footwear that includes an upper defining a foot-receiving cavity having an ankle opening. The heel insert includes a base. The heel insert includes a spine extending outward from the base to a tip of the spine such that the spine extends upward along a posterior wall of a heel region of the upper toward the ankle opening when the base is operatively connected to the heel region. The tip of the spine is moveable relative to the base between a first position and a second position along a longitudinal axis of the article of footwear. The heel insert includes a spring operatively connected to the spine such that the spring biases the tip of the spine toward the first position of the tip. The tip of the spine is resiliently deflectable toward the second position against the bias of the spring.

20 Claims, 14 Drawing Sheets

(56) References Cited

U.S. PATENT DOCUMENTS

| | | | | |
|---|---|---|---|---|
| 2013/0185959 | A1* | 7/2013 | Coleman | A43B 11/00 36/107 |
| 2015/0216252 | A1* | 8/2015 | Wiens | A43B 1/0054 36/105 |
| 2021/0204644 | A1* | 7/2021 | Kyle | A43B 3/12 |

FOREIGN PATENT DOCUMENTS

| | | | | |
|---|---|---|---|---|
| WO | 03073894 | A1 | 9/2003 | |
| WO | 2012168956 | A1 | 12/2012 | |
| WO | WO-2012168956 | A1 * | 12/2012 | A43B 11/00 |

OTHER PUBLICATIONS

Ladislav Sedivi, U.S. Pat. No. 879,011 issued Feb. 11, 1908.
Rodriquez, Kari, "International Search Report" and "Written Opinion", International Application No. PCT/US22/233166, dated Nov. 8, 2022, 8 pages.

* cited by examiner

FOOTWEAR HEEL INSERT

BACKGROUND

Putting an article of footwear on an individual's foot often requires the individual to use one or both hands and/or one or more tools (e.g., a shoehorn, etc.), for example to stretch the ankle opening and hold the heel region of the footwear to enable the individual's foot to slide into the foot-receiving cavity of the footwear through the ankle opening.

SUMMARY

In one aspect, a heel insert is provided for an article of footwear that includes an upper defining a foot-receiving cavity having an ankle opening. The heel insert includes a base configured to be operatively connected to a heel region of the upper. The heel insert includes a spine extending outward from the base to a tip of the spine such that the spine extends upward along a posterior wall of the heel region toward the ankle opening when the base is operatively connected to the heel region. The tip of the spine is moveable relative to the base between a first position along a longitudinal axis of the article of footwear and a second position along the longitudinal axis of the article of footwear. The heel insert includes a spring operatively connected to the spine such that the spring biases the tip of the spine toward the first position of the tip. The tip of the spine is resiliently deflectable toward the second position against the bias of the spring.

In another aspect, an article of footwear includes an upper extending a length along a longitudinal axis of the article of footwear. The upper defines a foot-receiving cavity having an ankle opening. The upper includes a heel region having a posterior wall. The article of footwear includes a heel insert that includes a base operatively connected to the heel region of the upper. The heel insert includes a spine extending outward from the base to a tip of the spine such that the spine extends upward along the posterior wall of the heel region toward the ankle opening. The tip of the spine is moveable relative to the base between a first position along the longitudinal axis of the article of footwear and a second position along the longitudinal axis of the article of footwear. The heel insert includes a spring operatively connected to the spine such that the spring biases the tip of the spine toward the first position of the tip. The tip of the spine is resiliently deflectable toward the second position against the bias of the spring.

In another aspect, a method for assembling an article of footwear includes operatively connecting a spring to a spine of a heel insert having a tip that is moveable relative to a base of the heel insert between a first position and a second position such that the spring biases the tip toward the first position. The method includes installing the heel insert within a heel region of an upper of the article of footwear such that the tip of the spine is resiliently deflectable along a longitudinal axis of the article of footwear from the first position toward the second position.

DETAILED DESCRIPTION

Figure 1:
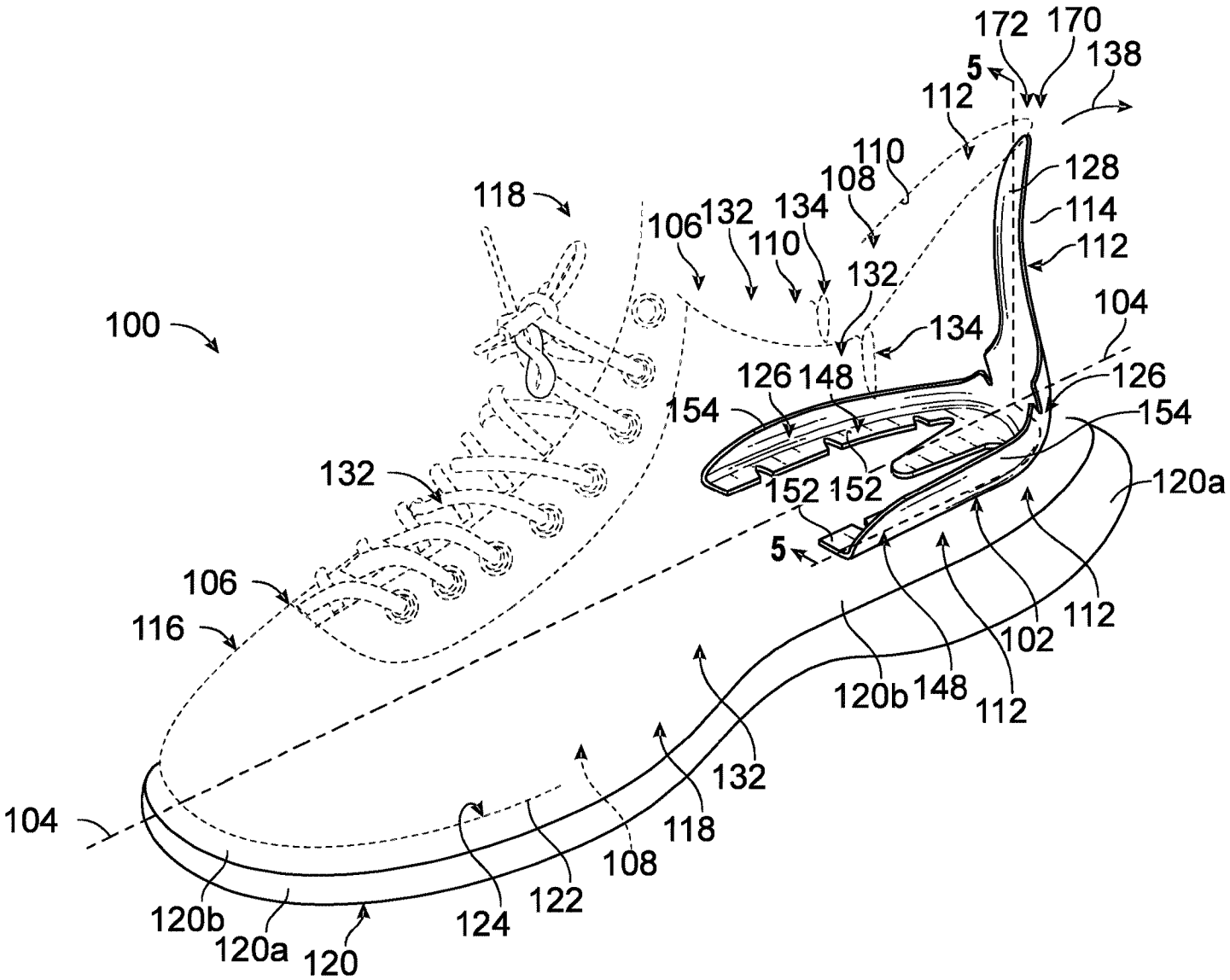
FIG. 1 is a perspective view illustrating an article of footwear according to an implementation.

The foregoing summary, as well as the following detailed description of certain implementations will be better understood when read in conjunction with the appended drawings. As used herein, an element or step recited in the singular and preceded by the word "a" or "an" should be understood as not necessarily excluding the plural of the elements or steps. Further, references to "one implementation" are not intended to be interpreted as excluding the existence of additional implementations that also incorporate the recited features. Moreover, unless explicitly stated to the contrary, implementations "comprising" or "having" an element or a plurality of elements having a particular property can include additional elements not having that property.

While various spatial and directional terms, such as "top," "bottom," "upper," "lower," "vertical," "upward," and/or the like are used to describe implementations of the present application, it is understood that such terms are merely used with respect to the orientations shown in the drawings. The orientations can be inverted, rotated, or otherwise changed such that the spatial and directional terms apply differently, for example if the structure is flipped 180°: a top side becomes a bottom side; upward becomes downward; a left side becomes a right side; vice versa; and/or the like. Moreover, and for example, vertical may become horizontal when the structure is rotated 90°.

Slipping an individual's foot into the upper of an article of footwear can be difficult without using one or both hands and/or one or more tools (e.g., a shoehorn, etc.). For example, a hand and/or tool may be required to stretch the ankle opening of the footwear and hold the heel region of the upper in the stretched position to enable the foot to be successfully inserted into the foot-receiving cavity of the upper. The heel inserts and methods disclosed herein alleviate this difficulty by providing a resiliently deflectable spine 128 that enables an individual's foot to be received into the foot-receiving cavity of the upper of an article of footwear without the use of a hand and/or other tools (e.g., only the individual's foot is used for successful insertion into the foot-receiving cavity, etc.). The heel inserts and methods disclosed herein thus enhance the ease of foot entry, allowing hands-free foot entry into an article of footwear.

Certain implementations of the application provide a heel insert for an article of footwear that includes an upper defining a foot-receiving cavity having an ankle opening. The heel insert includes a base configured to be operatively connected to a heel region of the upper. The heel insert includes a spine extending outward from the base to a tip of the spine such that the spine extends upward along a posterior wall of the heel region toward the ankle opening when the base is operatively connected to the heel region. The tip of the spine is moveable relative to the base between a first position along a longitudinal axis of the article of footwear and a second position along the longitudinal axis of the article of footwear. The heel insert includes a spring operatively connected to the spine such that the spring biases the tip of the spine toward the first position of the tip. The tip of the spine is resiliently deflectable toward the second position against the bias of the spring. Certain implementations of the application ease foot entry into an article of footwear by enabling hands-free foot entry into the article of footwear.

Figure 14:
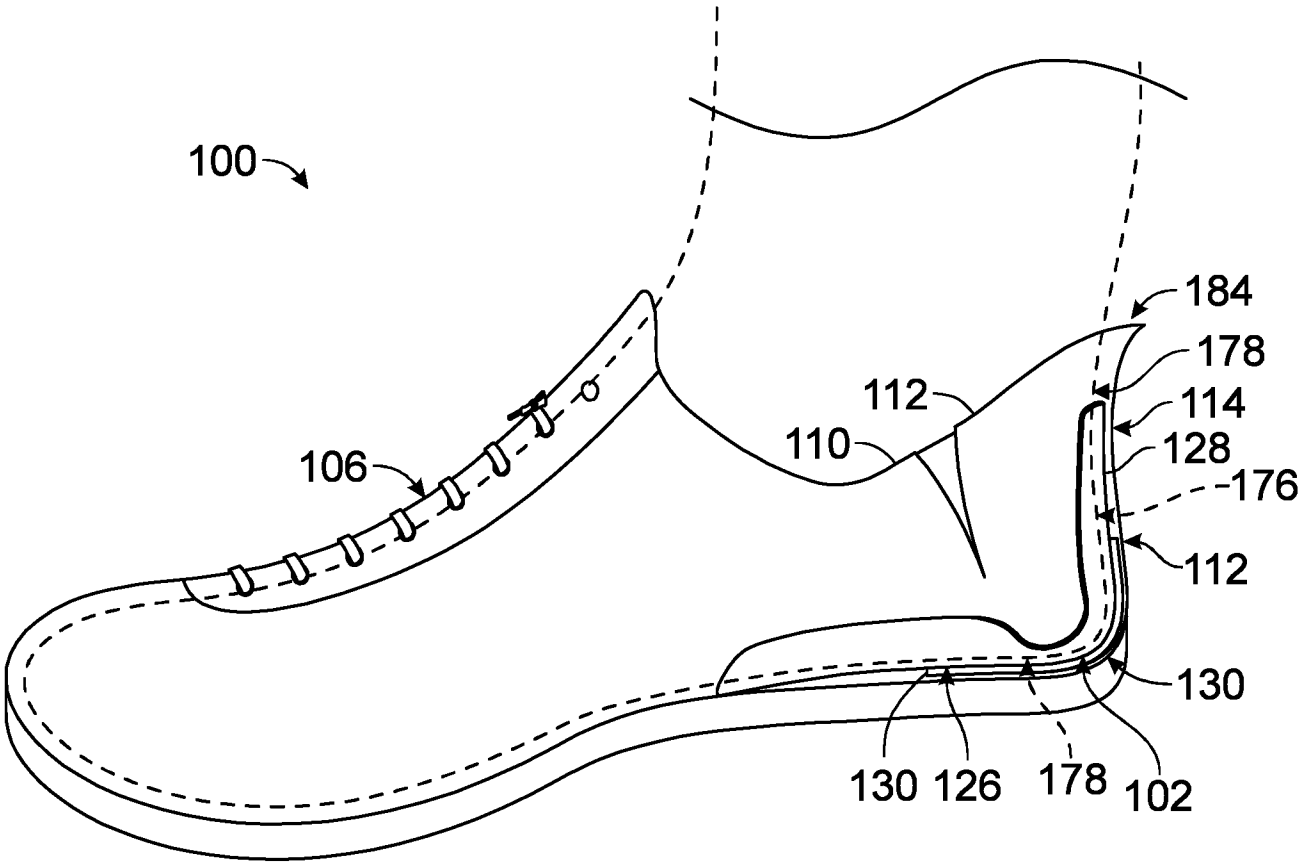

With references now to the figures, FIG. 1 illustrates an article of footwear 100 that includes a heel insert 102 that is configured to facilitate (e.g., ease, assist, etc.) entry of an individual's foot into the footwear 100. The footwear 100 extends a length along a longitudinal axis 104. The footwear 100 includes an upper 106 that extends a length along the longitudinal axis 104. The upper 106 defines a foot-receiving cavity 108 having an ankle opening 110. The foot-receiving cavity 108 is configured to receive an individual's foot (e.g., as shown in FIG. 14, etc.) therein through the ankle opening 110. The footwear 100 illustrated herein is depicted as an athletic shoe, but the footwear 100 is not limited to athletic shoes generally nor the specific type, design, category, and/or the like of athletic shoe illustrated herein. Rather, the footwear 100 may include any article of footwear (e.g., any type, design, category, functionality, etc.), such as, but not limited to, leisure shoes, dress shoes, work shoes, sandals, slippers, boots, booties, and/or the like.

As shown in FIG. 1 and will be described below, the heel insert 102 is configured to be installed within a heel region 112 of the upper 106 of the footwear 100. The heel region 112 generally includes portions of the footwear 100 corresponding with the posterior (i.e., rear or back) portions of a human foot (e.g., including the heel, including the calcaneus bone, including at least a portion of the Achilles tendon, etc.) when the footwear 100 is worn by a human individual. For example, the heel region 112 of the upper 106 includes a posterior wall 114 that is configured to extend behind and support the posterior of an individual's heel when the individual's foot is received within the foot-receiving cavity 108 of the upper 106 (e.g., as shown in FIG. 14, etc.).

The upper 106 of the footwear 100 includes a forefoot region 116 that generally includes portions of the footwear 100 corresponding with the anterior (i.e., front) portions of a human foot (e.g., including the toes, the joints connecting the metatarsals with the phalanges, etc.) when the footwear 100 is worn by a human individual. For example, the forefoot region 116 of the upper 106 extends over at least a portion of the anterior of an individual's foot when the individual's foot is received within the foot-receiving cavity 108, for example as shown in FIG. 14, etc. A midfoot region 118 of the footwear 100 is disposed between the heel region 112 and the forefoot region 116 and generally includes portions of the footwear 100 corresponding with an arch area of the human foot (e.g., including the navicular joint, etc.) when the individual's foot is received within the foot-receiving cavity 108 of the upper 106 (e.g., as shown in FIG. 14, etc.).

The footwear 100 includes a sole structure 120 to which the upper 106 is secured. The sole structure 120 includes one or more sole components that define any number of layers of the sole structure 120. For example, the sole structure 120 includes an outsole **120*a* and a midsole 120*b* in the exemplary implementation shown in FIG. 1. In another example, the sole structure 120 has a unitary combination of an outsole and a midsole (which for example may be referred to as a unisole). The sole structure 120 underlies the upper 106. For example, a bottom wall 122 (e.g., a lasting board, etc.) of the upper 106 is secured to an upper side 124 (e.g., of the midsole 120*b*) of the sole structure 120**, for example using any suitable method, means, structure, material, fastener, and/or the like, such as, but not limited to, adhesive, cement, thermal bonding, welding, stitching, sewing, riveting, and/or the like.

Traditionally, slipping an individual's foot into the upper of an article of footwear often requires the use of one or both hands and/or one or more tools (e.g., a shoehorn, etc.) to stretch the ankle opening and hold the heel region of the upper in the stretched position as the foot is inserted into the foot-receiving cavity of the upper. The heel insert 102 of the present application alleviates this difficulty by enabling an individual's foot to be received into the foot-receiving cavity of the upper of an article of footwear without the use of a hand and/or other tools (e.g., only the individual's foot is used for successful insertion into the foot-receiving cavity, etc.). In other words, the various implementations of heel inserts and methods disclosed herein enhance the ease of foot entry, allowing hands-free foot entry into an article of footwear. As will be described in more detail below, the heel insert 102 includes a base 126, a spine 128, and a spring 130 (not visible in FIG. 1).

Optionally, the upper 106 includes a stretchable material (e.g., an elastic material, a stretchable fabric, a 4-way stretch nylon fabric, etc.) along and/or adjacent the heel region 112 of the upper 106 to increase the amount of stretching of the ankle opening 110 along the longitudinal axis 104, for example to facilitate (e.g., assist, etc.) the functionality of the heel insert 102 (e.g., enabling stretching of the ankle opening 110 along the longitudinal axis 104, enabling entry of an individual's foot into the footwear 100 without the use of a hand and/or other tools, etc.). For example, in the exemplary implementation of FIG. 1, sidewalls 132 of the upper 106 include optional elastic stretch points 134 that increase the amount of stretching of the ankle opening 110 along the longitudinal axis 104. In other words, the stretch points 134 are configured to enable an end 170 of the posterior wall 114 of the heel region 112 of the upper 106 to move along the longitudinal axis 104 of the footwear 100 (e.g., in the direction of the arrow 138, etc.). In another example, one or more segments (e.g., the sidewalls 132 within and/or adjacent to the heel region 112, the posterior wall 114 of the heel region 112, etc.) of the upper 106 optionally includes a stretchable material to enable the ankle opening 110 to stretch further along the longitudinal axis 104. In some implementations, the upper 106 does not include a stretchable material.

Figure 2:
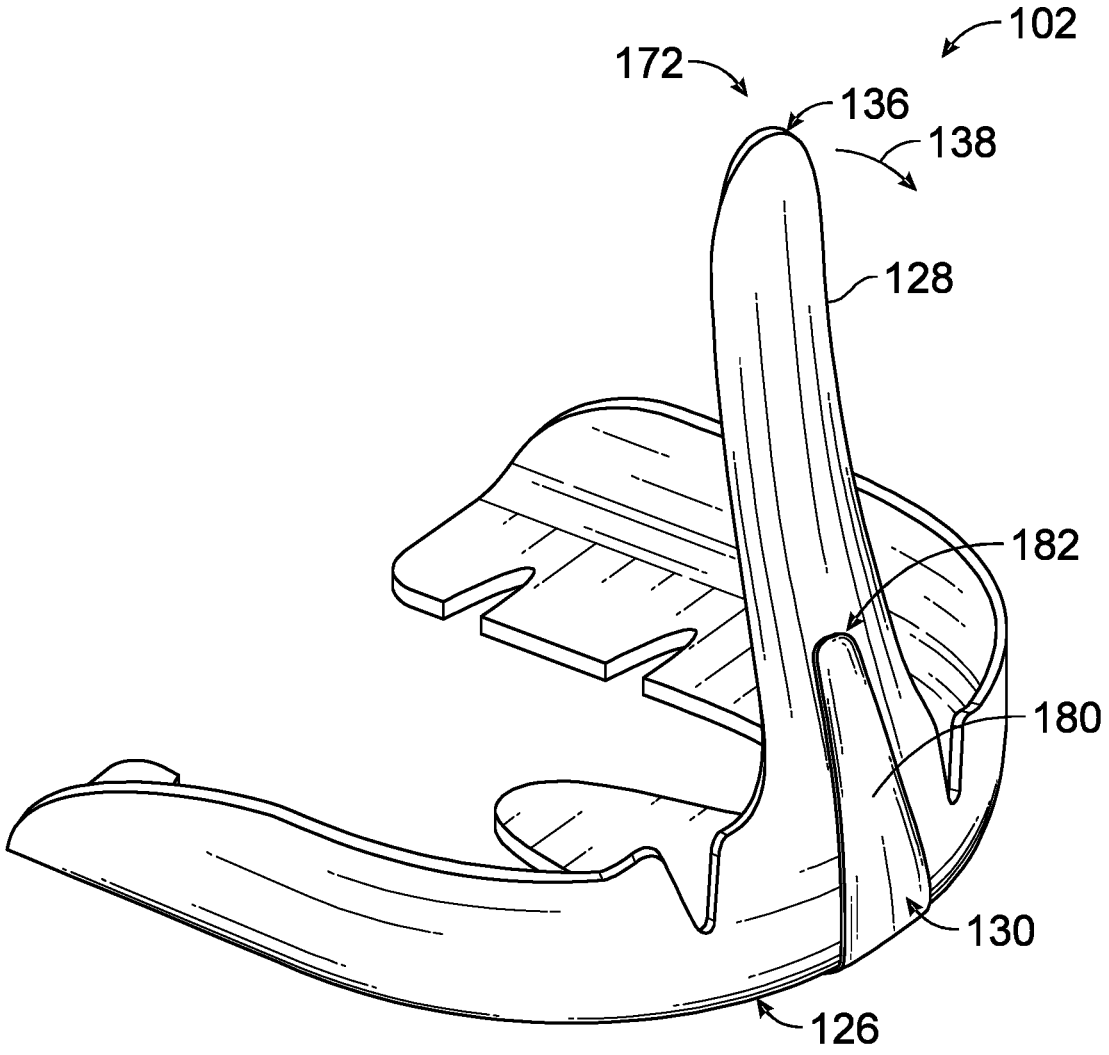
FIG. 2 is a perspective view illustrating a heel insert according to an implementation.
Figure 3:
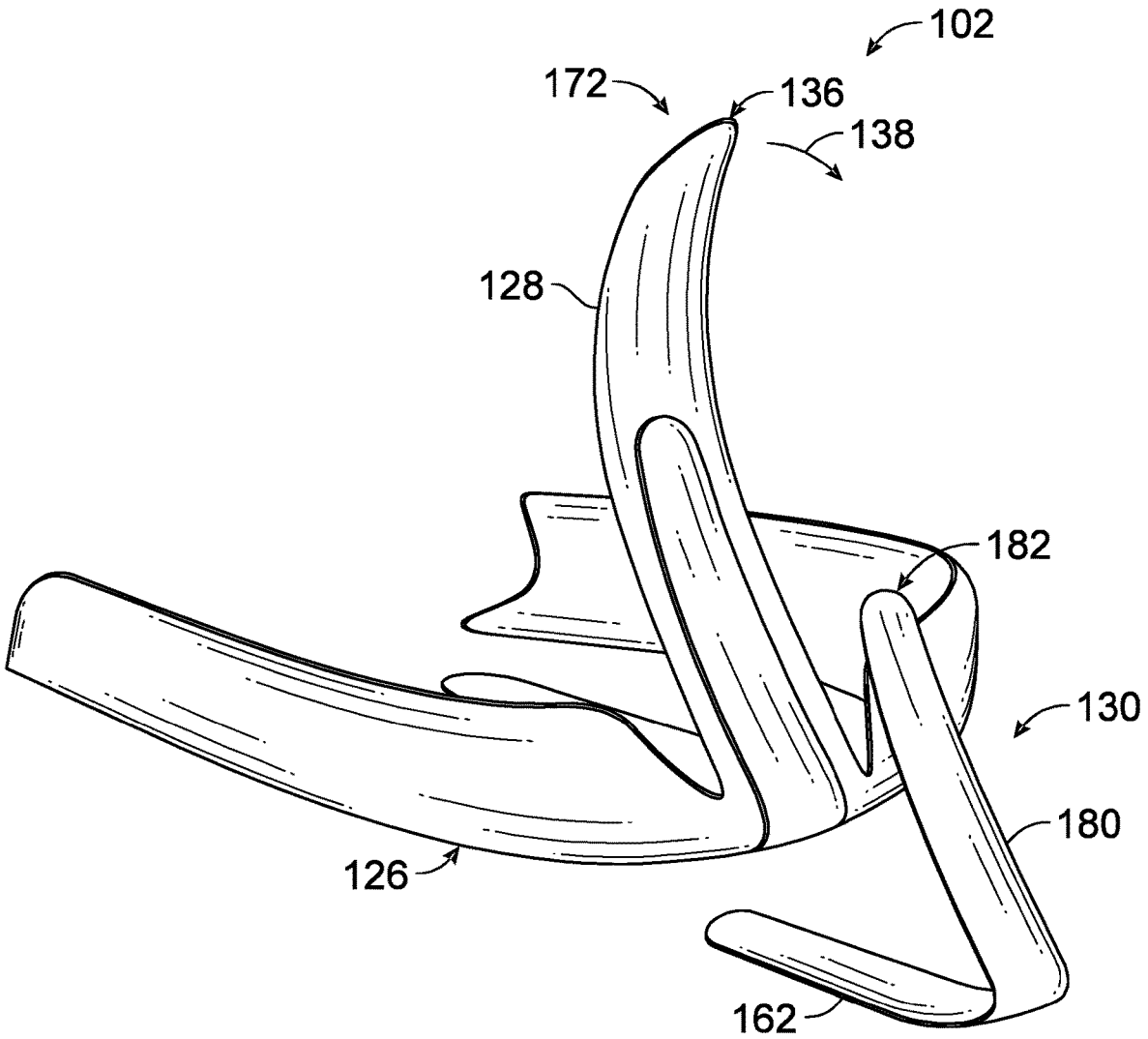
FIG. 3 is an exploded perspective view of the heel insert shown in FIG. 2 according to an implementation.

Referring now to FIGS. 2 and 3, the spine 128 of the heel insert 102 extends outward from the base 126 to a tip 136 of the spine 128. As will be described below, the spring 130 of the heel insert 102 is operatively connected to the spine 128 for providing a spring force that biases the spine 128 against movement in the direction 138.

Figure 4:
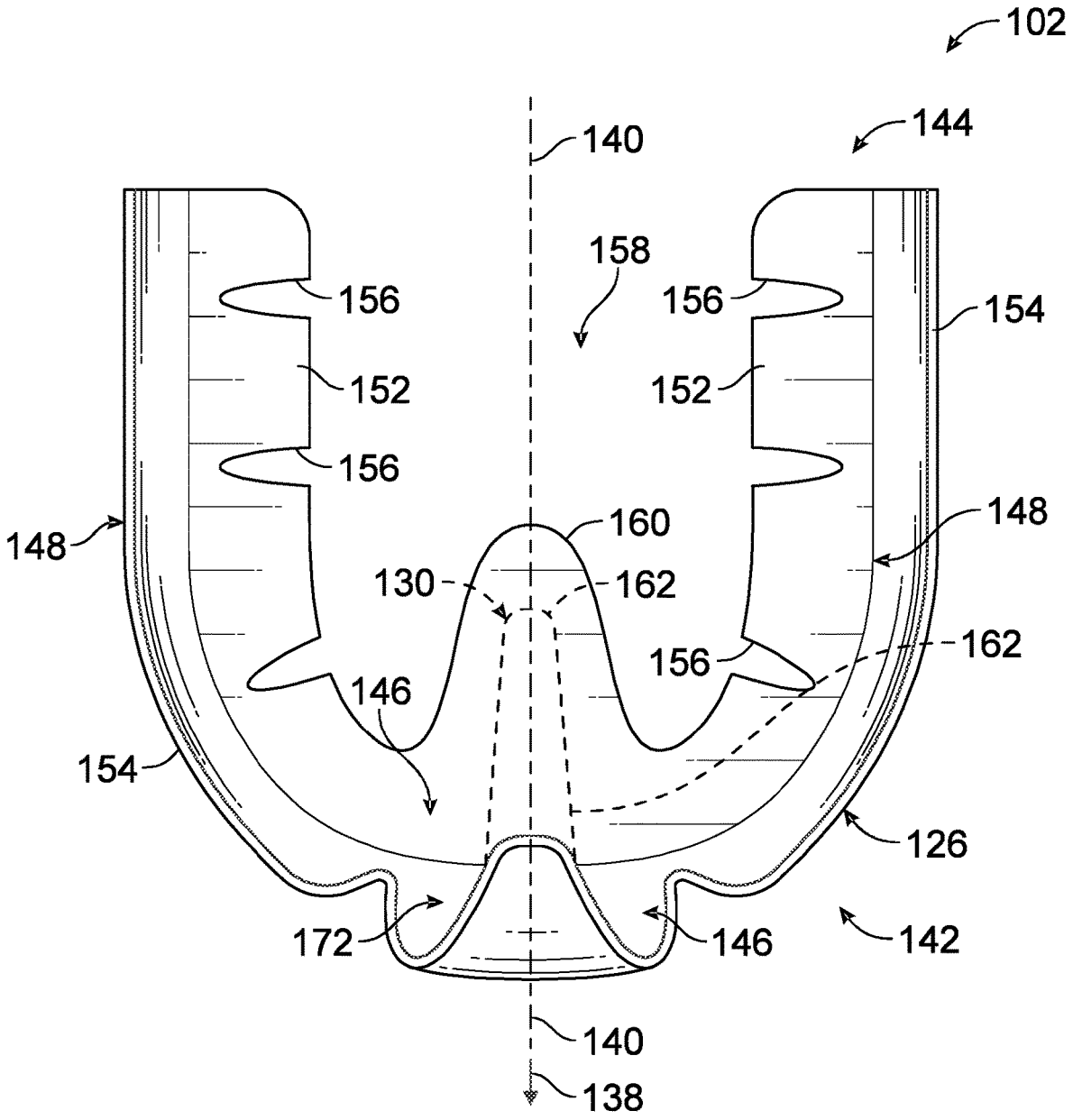
FIG. 4 is a plan view of the heel insert shown in FIG. 2 according to an implementation.

Referring now to FIG. 4, the base 126 extends a length along a longitudinal axis 140 from a rear end portion 142 to a front end portion 144. The rear end portion 142 of the base 126 includes a hub 146 of the base 126. The base 126 includes legs 148 that extend outward from the hub 146 along the longitudinal axis 140 to end portions 150 of the legs 148. In the exemplary implementation shown herein, the legs 148 include bottom walls 152 and side walls 154. As shown in FIG. 1, when the heel insert 102 is installed within the heel region 112 of the upper 106: the bottom walls 152 of the legs 148 extend along the bottom wall 122 of the upper 106 and the upper side 124 of the sole structure 120; and the side walls 154 of the legs 148 extend along the sidewalls 132 and the posterior wall 114 of the upper 106. In other examples, one or more of the legs 148 does not include the side wall 154 or the bottom wall 152.

Optionally, the end portions 150 of the legs 148 are free end portions such that the front end portion 144 of the base 126 is open. For example, in the exemplary implementation shown herein, the base 126 includes an open front end portion 144 and a closed rear end portion 142 that defines a U-shape (i.e., the base 126 includes a U-shape in the exemplary implementation). In addition or alternatively to the U-shape shown herein, the base 126 may include any other shape that enables the base 126 to function as described and/or illustrated herein, such as, but not limited to a shape that is closed at the front end portion 144, a V-shape, a horseshoe shape, a circular shape, an oval shape, a rectangular shape, a shape having three or more sides, and/or the like.

In some implementations, the open-ended shape of the front end portion 144 enables the heel insert 102 to be accommodated by (i.e., operatively connected to, used with, implemented within, etc.) a greater variety of different sizes and shapes of footwear. For example, the open-ended shape of the front end portion 144 of the base 126 enables the size and/or shape of the base 126 to be adjusted by moving the free end portions 150 of the legs 148 toward or away from each other. Accordingly, the open-ended shape of the front end portion 144 of the base 126 may reduce the number of different versions (e.g., sizes, shapes, etc.) of the heel insert 102 required to serve a given number of different sizes and shapes of footwear, which may reduce manufacturing costs. Optionally, one or more of the bottom walls 152 and/or one or more of the side walls 154 of the legs 148 of the base 126 include one or more slots and/or other openings that enable further adjustment of the size and/or shape of the base 126. For example, the exemplary implementation of the base 126 shown in FIG. 4 includes slots 156 that extend radially outward (relative to the longitudinal axis 140) into the bottom walls 152 of the legs 148 along an interior 158 of the U-shape of the base 126.

In the exemplary implementation shown herein, the base 126 includes an extension 160 that extends outward from the hub 146 along the longitudinal axis 140. As will be described below, the extension 160 is configured to support a base leg 162 of the spring 130.

Referring again to FIG. 1, as described above, the heel insert 102 is configured to be installed within the heel region 112 of the upper 106. For example, the base 126 is configured to be operatively connected to the heel region 112 of the upper 106. In other words, the base 126 is configured to be installed (i.e., implemented) within the heel region 112 of the upper 106 in any manner, configuration, and/or the like that enables the heel insert 102 to function as described and/or illustrated herein (e.g., such that the base 126 enables the spine 128 and/or spring 130 of the heel insert 102 to function as described and/or illustrated herein, etc.).

Figure 5:
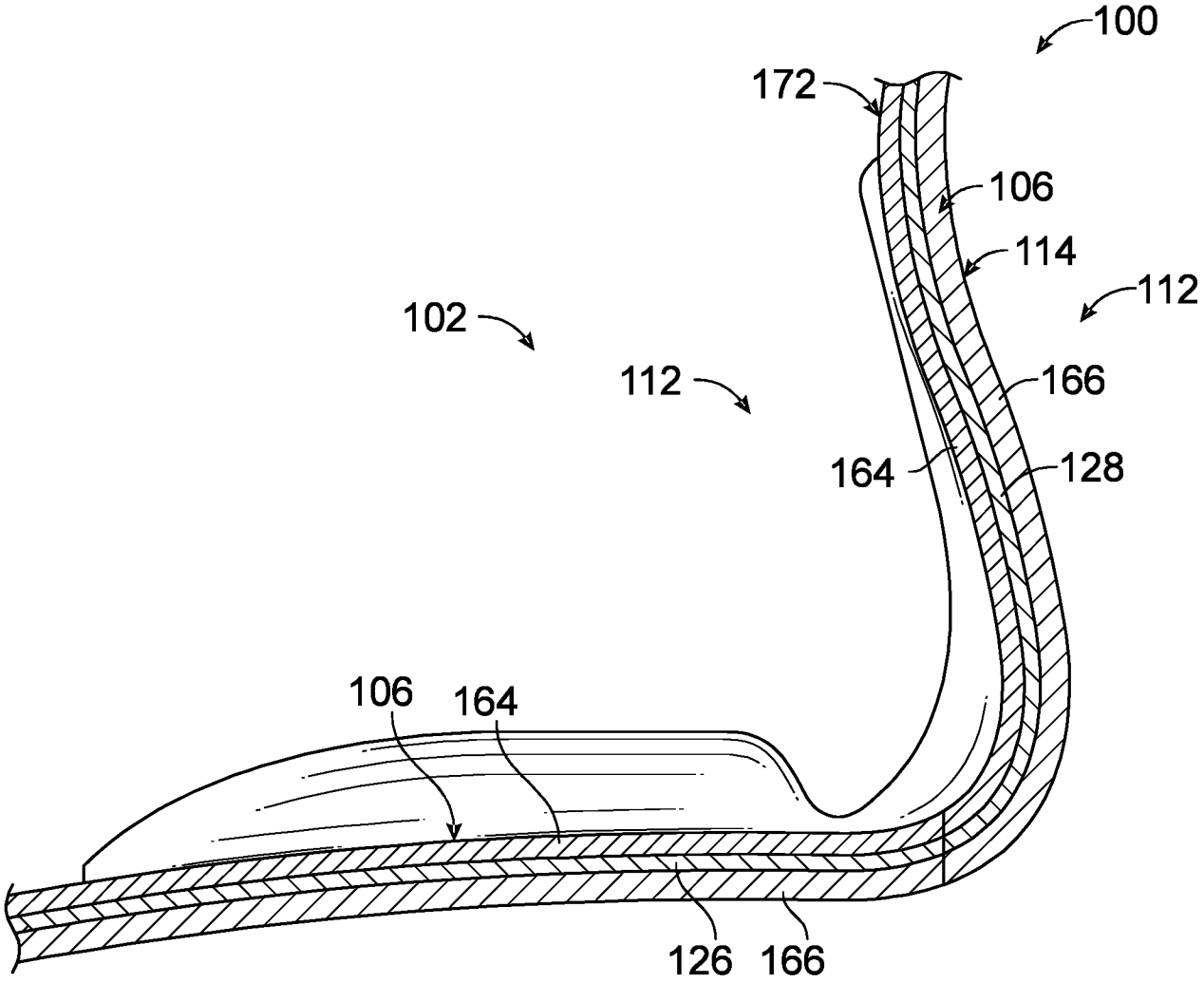
FIG. 5 is a cross-sectional view of the footwear shown in FIG. 1 taken along line 5-5 of FIG. 1.

As shown in the cross section of FIG. 5, in the exemplary implementation of the heel insert 102, the base 126 is operatively connected to the heel region 112 such that: the base 126 is embedded within the upper 106 between a liner 164 of the upper 106 and an exterior layer 166 of the upper 106; and the spine 128 of the heel insert 102 is embedded within the upper 106 along the posterior wall 114 between the liner 164 and the exterior layer 166. In other words, the base 126 extends between the liner 164 and the exterior layer 166 of the upper 106 when the base 126 is operatively connected to the heel region 112 of the upper 106.

Figure 6:
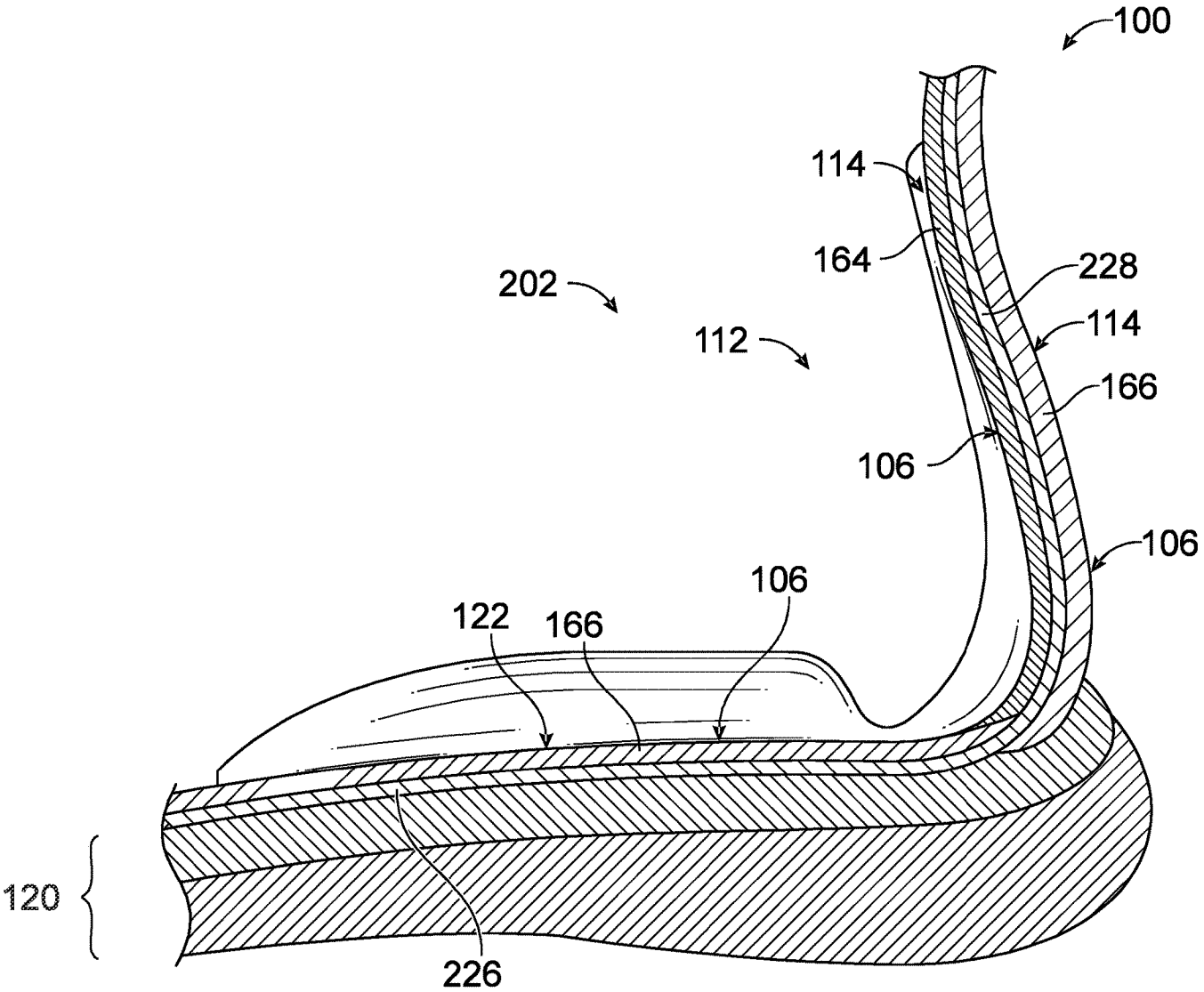
FIG. 6 is a cross-sectional view illustrating installation of a heel insert into the footwear shown in FIG. 1 according to an implementation.

In another example, the heel insert 102 is partially embedded within the heel region 112 of the upper 106 when the base 126 is operatively connected to the heel region 112. For example, FIG. 6 illustrates a cross section wherein a base 226 of a heel insert 202 is operatively connected to the heel region 112 of the upper 106 such that: a spine 228 of the heel insert 202 is embedded within the upper 106 between the liner 164 and the exterior layer 166 of the upper 106 along the posterior wall 114; and the base 226 of the heel insert 202 extends between the exterior layer 166 of the upper 106 and the sole structure 120 of the footwear 100. The configuration shown in FIG. 6 illustrates an example that may be implemented in designs wherein the bottom wall 122 of the upper 106 includes only a single layer of material, for example as is shown in the example installation of FIG. 6. In other examples, the bottom wall 122 of the upper 106 includes two or more layers (e.g., the liner 164 and the exterior layer 166, etc.), for example as is shown in FIG. 5.

Figure 7:
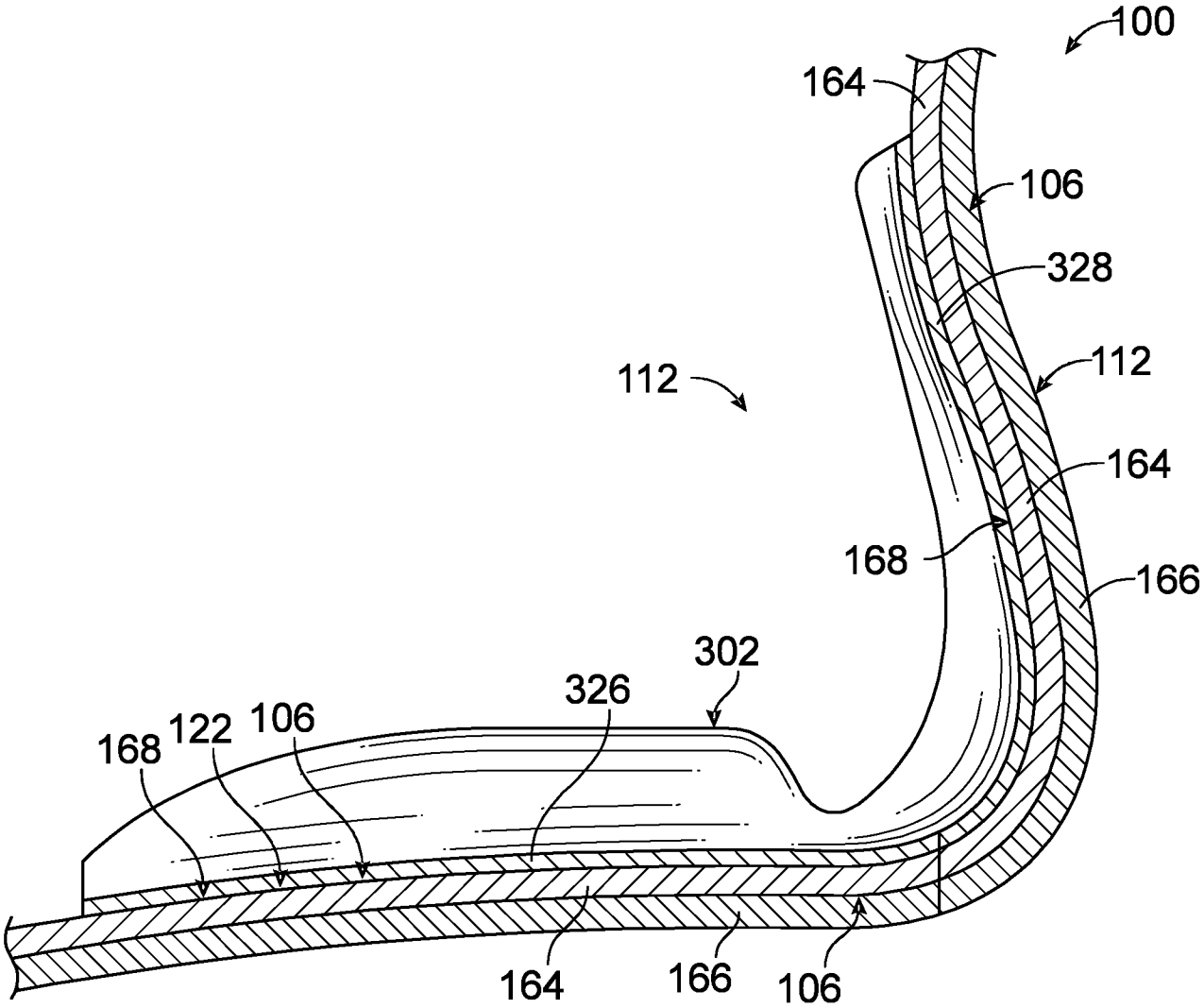
FIG. 7 is a cross-sectional view illustrating installation of a heel insert into the footwear shown in FIG. 1 according to an implementation.

In yet another example of installation of the heel insert 102 within the heel region 112 of the upper 106, the heel insert 102 is not embedded within the upper 106 when the base 126 is operatively connected to the heel region 112, but rather extends along an interior side 168 of the liner 164 of the upper 106. For example, FIG. 7 illustrates a cross section wherein a base 326 of a heel insert 302 is operatively connected to the heel region 112 of the upper 106 such that: a spine 328 of the heel insert 302 extends along the interior side 168 of the liner 164 of the upper 106 along the posterior wall 114; and the base 326 of the heel insert 302 extends along the interior side 168 of the bottom wall 122 of the upper 106 (e.g.; along the interior side 168 of a single layer bottom wall 122 such as, but not limited to, the single layer bottom wall shown in FIG. 6; along the interior side 168 of a liner 164 of the bottom wall 122 as shown in FIG. 7; between an insert and the bottom wall 122 of the upper 106; etc.). In yet other examples of installation of the heel insert 102 within the heel region 112 of the upper 106, one of the base 126 or the spine 128 extends along the interior side 168 of the upper 106 with the other of the base 126 or the spine 128 being embedded within the upper 106 or extending between the bottom wall 122 of the upper 106 and the sole structure 120 (not shown in FIG. 7) of the footwear 100.

Referring now to FIGS. 2, 3, and 8-10, the spine 128 of the heel insert 102 extends a length outward from the base 126 to the tip 136 of the spine 128. The length of the spine 128 extends from the base 126 to the tip 136 along a path P (best seen in FIG. 10). The tip 136 of the spine 128 is moveable relative to the base 126 between a first position 172 and a second position 174. The first position 172 of the tip 136 is the natural resting position of the spine 128 shown in FIGS. 1-5, 8-10, and 13. In the second position 174, the tip 136 has been moved (e.g., deflected, etc.) from the natural resting position in the direction 138. An example of the second position 174 of the tip 136 is shown in phantom in FIG. 13. As will be described below, when the base 126 is operatively connected to the heel region 112 of the upper 106, the spine 128 is positioned along the posterior wall 114 of the heel region 112 such that the tip 136 moves between the first and second positions 172 and 174, respectively, along the longitudinal axis 104 of the footwear 100. As will also be described below, movement of the tip 136 from the first position 172 toward the second position 174 is configured to stretch the ankle opening 110 of the upper 106 along the longitudinal axis 104 of the footwear 100.

Figure 13:
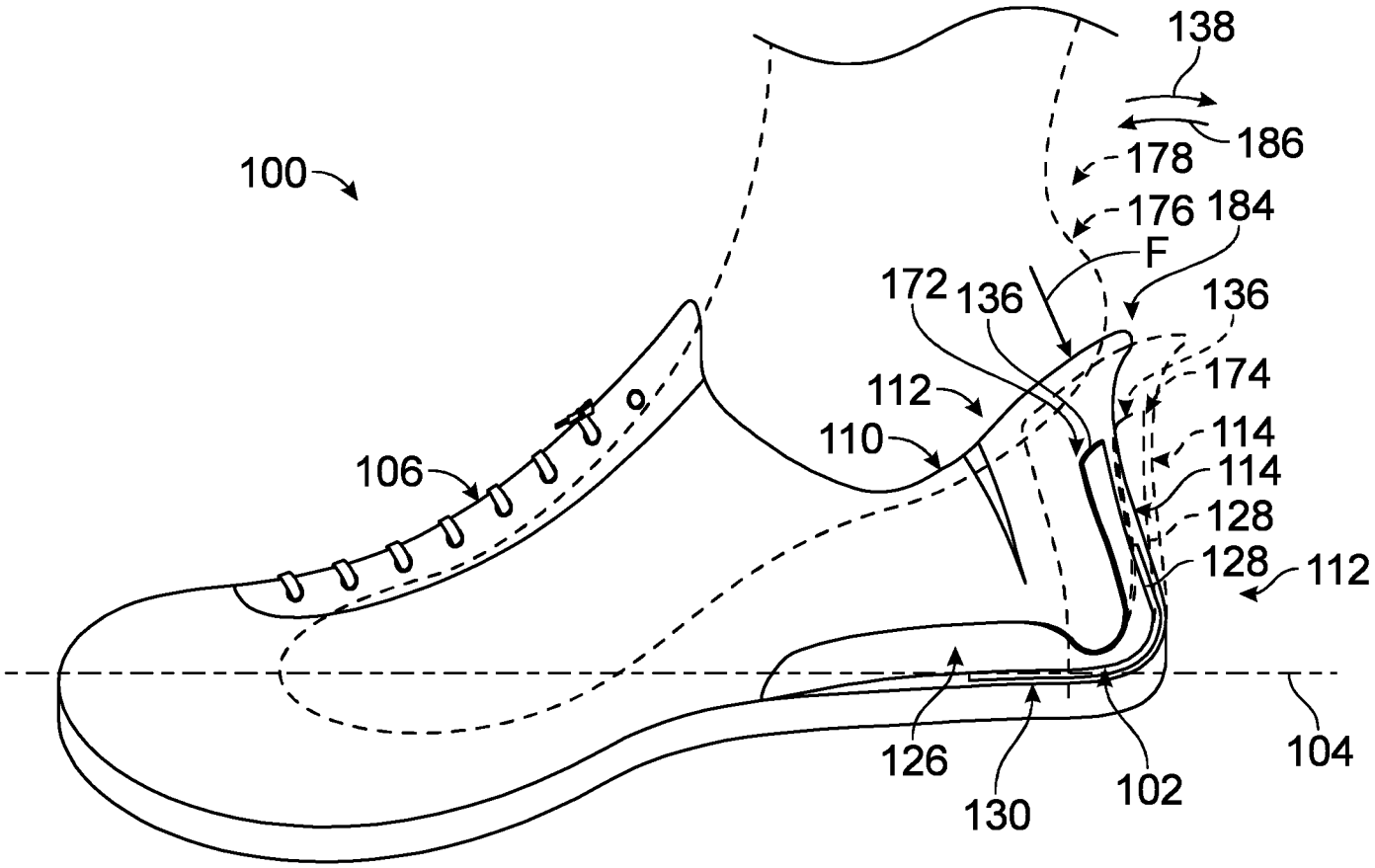
FIGS. 13 and 14 are schematic diagrams illustrating operation of the heel insert shown in FIG. 2 within the footwear shown in FIG. 1 according to an implementation.

As shown in FIGS. 1, 13, and 14, when the base 126 is operatively connected to the heel region 112 of the upper 106 (i.e., when the heel insert 102 is installed within the heel region 112 of the upper 106), the spine 128 of the heel insert 102 extends upward along the posterior wall 114 of the heel region 112 toward the ankle opening 110. Optionally, the path P (shown in FIG. 10) of the spine 128 has a shape that is complementary with a shape of the posterior wall 114 of the heel region 112 of the upper 106. In some implementations, the spine 128 is configured to provide heel counter functionality or assist the functionality of a heel counter (not shown) of the heel region 112 of the upper 106. For example, in some implementations the spine 128 facilitates holding the heel region 112 open (i.e., facilitates preventing the heel region 112 of the upper 106 from collapsing).

Figure 10:
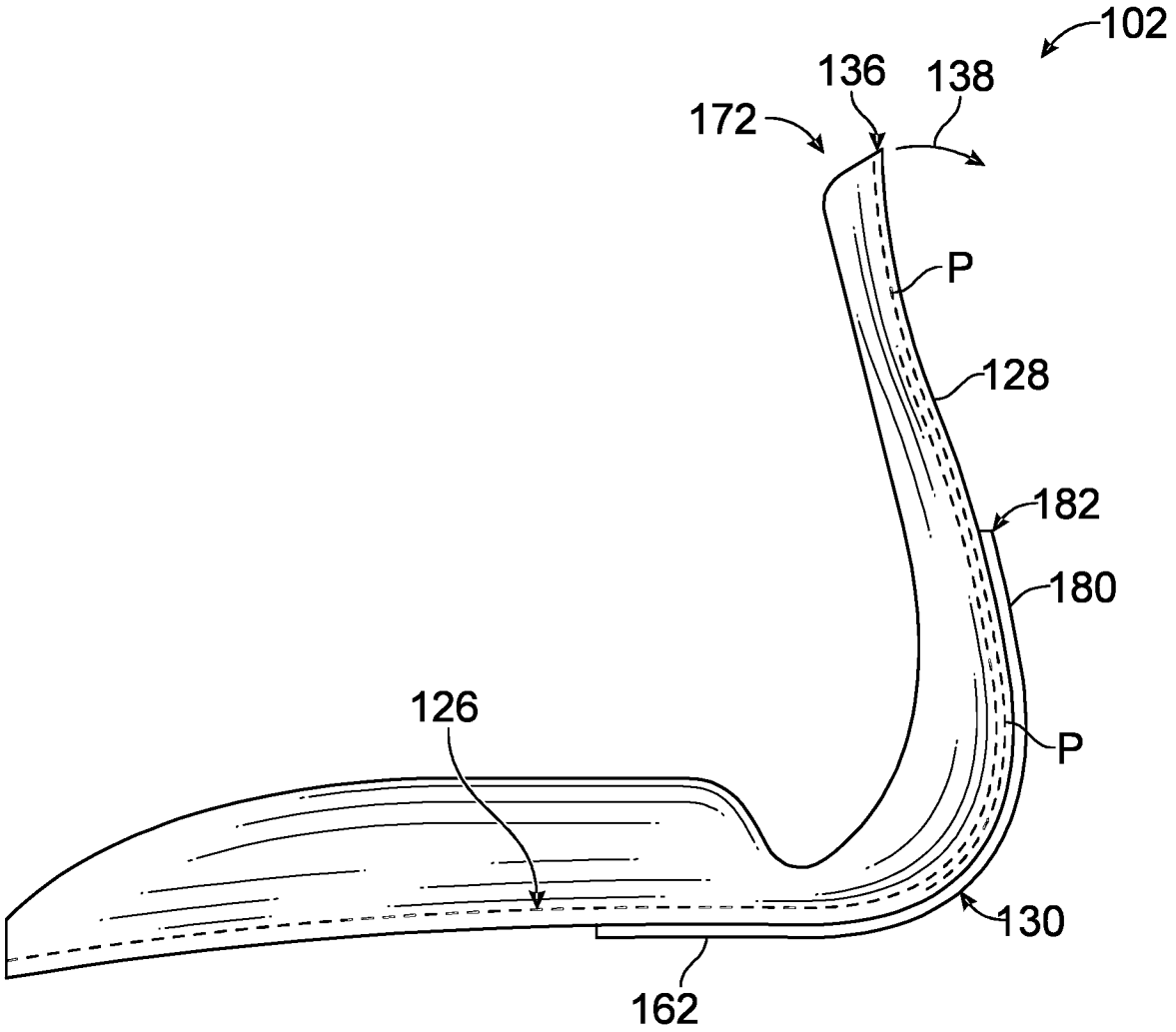
FIG. 10 is a side elevational view of the heel insert shown in FIG. 2 according to an implementation.

As shown in FIG. 14, the spine 128 extends behind a posterior 176 (i.e., rear or back) of an individual's heel 178 when the footwear 100 is worn by the individual (i.e., when the individual's foot is received within the foot-receiving cavity 108 of the upper 106). In some implementations, the spine 128 is configured to support and/or provide tension against the posterior 176 of the individual's heel 178, as will be described below. The shape of the path P (shown in FIG. 10) of the length of the spine 128 may be selected to facilitate providing the support of and/or tension against the posterior 176 of the individual's heel 178. For example, in the exemplary implementations shown herein, the path P of the length of the spine 128 includes an S-curve shape, as is best seen in FIG. 10. In some implementations, the offsetting curves of the S-curve shape of the path P of the length of the spine 128 creates a spring-like structure that enables the length of the spine 128 to act as a shock absorber. In addition or alternative to the S-shape shown herein, the length of the spine 128 may include any other shape that enables the spine 128 to function as described and/or illustrated herein (e.g., enables the spine 128 to move between the first and second positions, enables the spine 128 to resiliently deflect from the first position toward the second position, enables the spine 128 to provide support to and/or tension against the posterior of an individual's heel, etc.).

Referring again to FIGS. 2 and 3, the base 126 and the spine 128 may each be fabricated from any material(s) that enable the heel insert 102 to function as described and/or illustrated herein. Examples of suitable materials used to fabricate the base 126 and/or the spine 128 include, but are not limited to, plastics, thermoplastics (e.g., polypropylene, polyethylene, etc.), nylon, polyether block amide, fiberglass reinforced polyamides, elastomeric materials, wood, metals, metal alloys, metal composites, composite materials (e.g., carbon fiber, fiberglass, Kevlar®, metal matrix composites, etc.), and/or the like.

In the exemplary implementation, the base 126 and the spine 128 of the heel insert 102 are integrally formed as a single, unitary structure, as is shown herein. The base 126 and the spine 128 may be integrally formed using any suitable method, means, process, and/or the like, such as, but not limited to, molding, casting, machining, three dimensional (3D) printing, and/or the like.

Figure 11:
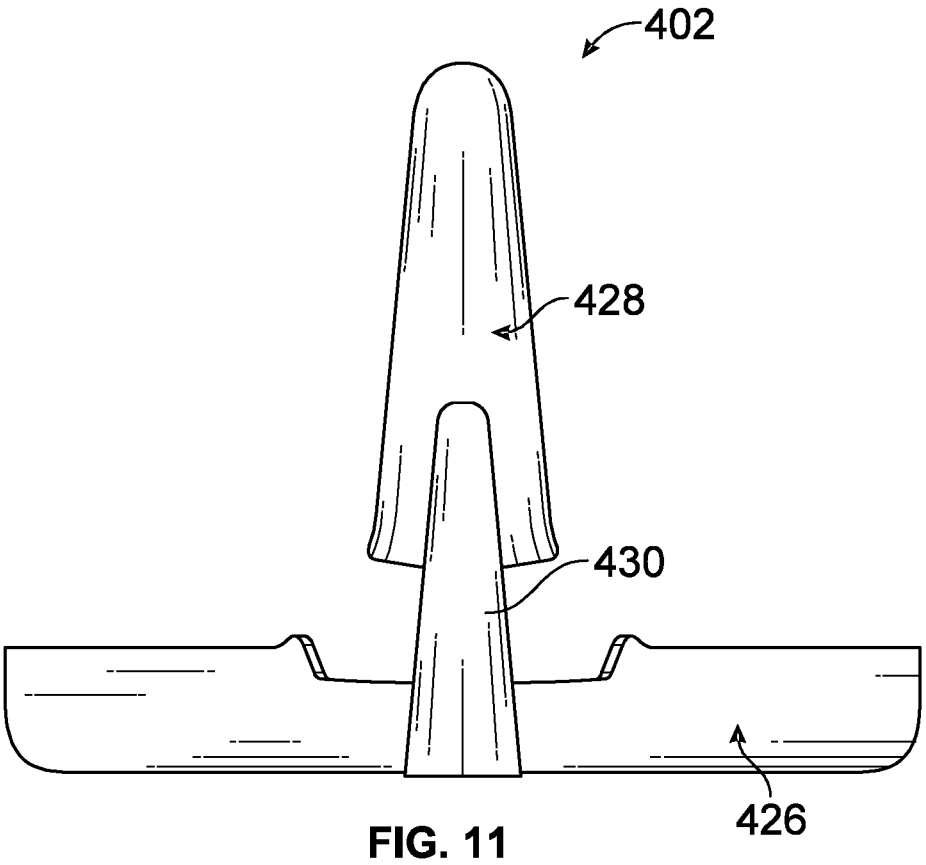
FIG. 11 is a rear elevational view illustrating a heel insert according to an implementation.

In other implementations, the base 126 and the spine 128 are not integrally formed as a single, unitary structure, but rather the base 126 and spine 128 are discrete components that are connected together using any suitable method, means, connector, fastener, manner, and/or the like, such as, but not limited to, adhesive, cement, bonding, welding, melding, heat molding, brazing, soldering, threaded fasteners, rivets, clips, pins, a snap-fit connection, an interference-fit connection, and/or the like. For example, FIG. 11 illustrates an example implementation wherein a base 426 and a spine 428 of a heel insert 402 are discrete components that are connected together via a spring 430 of the heel insert 402.

Referring now to FIGS. 2-4, the spring 130 of the heel insert 102 is operatively connected to the spine 128 of the heel insert 102 such that the spring 130 biases the tip 136 of the spine 128 toward the first position 172 of the tip 136. In other words, the spring 130 is operatively connected to the spine 128 such that the spring 130 provides a spring force that biases the spine 128 against movement away from the first position 172 in the direction 138. The spring force provided by the spring 130 configures the spine 128 to be resiliently deflectable toward the second position 174 (shown in FIG. 13) of the tip 136 (away from the first position 172) against the bias of the spring 130 (i.e., resiliently deflectable in the direction 138).

In the exemplary implementations shown herein, the spring 130 is a cantilever spring. For example, the spring 130 includes a base leg 162 (not visible in FIG. 2) and a spine leg 180 (not visible in FIG. 4) that extends outward from the base leg 162. The spine leg 180 extends a length outward from the base leg 162 to a tip 182 of the spine leg 180. The spine leg 180 is cantilevered from the base leg 162 such that the tip 182 is resiliently deflectable in the direction 138 against a bias of the spine leg 180 to the natural resting position of the spine leg 180 shown in FIGS. 2-4.

Figure 8:
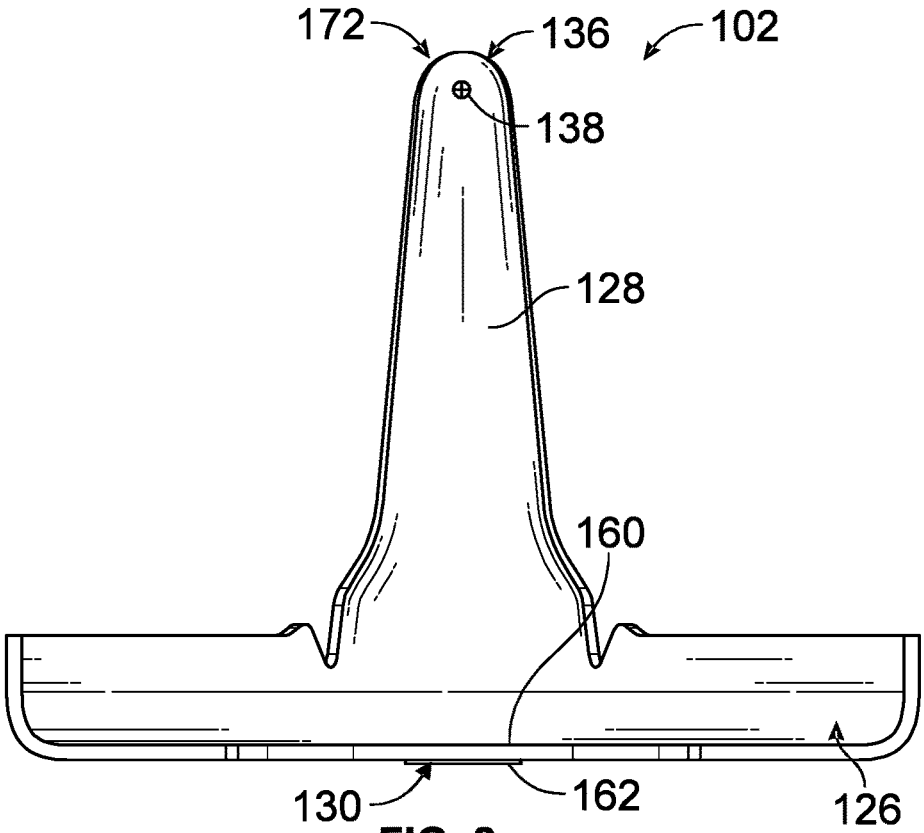
FIG. 8 is a front elevational view of the heel insert shown in FIG. 2 according to an implementation.
Figure 9:
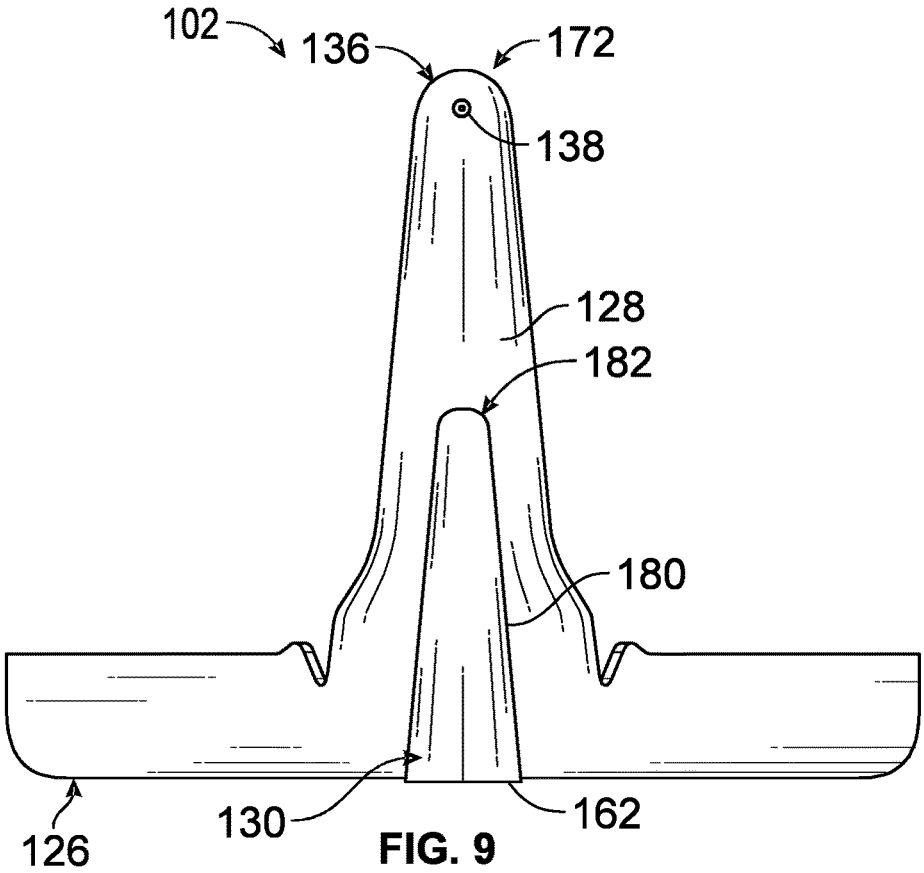
FIG. 9 is a rear elevational view of the heel insert shown in FIG. 2 according to an implementation.

As best seen in FIGS. 4, 8, and 9, in the exemplary implementation, the spring 130 is operatively connected to the spine 128 of the heel insert 102 such that the base leg 162 of the spring 130 extends along the extension 160 of the base 126 of the heel insert 102. The base leg 162 of the spring 130 is connected to the extension 160 (e.g., as described below) and/or is sandwiched between the extension 160 and the upper 106 and/or the sole structure 120 of the footwear 100. Accordingly, the extension 160 supports (e.g., holds in place, etc.) the base leg 162 of the spring 130 to enable the tip 182 of the spine leg 180 to resiliently deflect in the direction 138 relative to the base leg 162.

As best seen in FIG. 2, the spring 130 is operatively connected to the spine 128 of the heel insert 102 such that the spine leg 180 of the spring 130 extends along the spine 128 of the heel insert 102. The spine leg 180 is connected to the spine 128 (e.g., as described below). Accordingly, the spine leg 180 of the spring 130 provides a spring force that resists (i.e., biases against) movement of the spine 128 away from the first position 172 in the direction 138 toward the second position 174.

In addition or alternatively to a cantilever spring, the spring 130 may include any other type of spring that enables the spring 130 to function as described and/or illustrated herein (e.g., to provide a spring force that configures the spine 128 to be resiliently deflectable in the direction 138, etc.), such as, but not limited to, coil springs, leaf springs, torsion springs, flat springs, and/or the like.

The spring 130 may be fabricated from any material(s) that enable the spring 130 to function as described and/or illustrated herein (e.g., to provide a spring force that configures the spine 128 to be resiliently deflectable in the direction 138, etc.). Examples of suitable materials used to fabricate the spring 130 include, but are not limited to, metals, metal alloys, metal composites, composite materials (e.g., carbon fiber, fiberglass, Kevlar®, metal matrix composites, etc.), elastomeric materials, plastics, thermoplastics, nylon, polyether block amide, fiberglass reinforced polyamides, wood, and/or the like.

As described above, the spine leg 180 of the spring 130 is connected to the spine 128. Optionally the base leg 160 of the spring 130 is connected to the extension 160 of the base 126. The spring 130 may be connected to the spine 128 and/or the extension 160 using any suitable method, means, connector, fastener, manner, and/or the like, such as, but not limited to, adhesive, cement, bonding, welding, melding, heat molding, brazing, soldering, threaded fasteners, rivets, clips, pins, a snap-fit connection, an interference-fit connection, and/or the like.

In other implementation, the spring 130 and the spine 128 are integrally formed as a single, unitary structure. The spring 130 and the spine 128 may be integrally formed using any suitable method, means, process, and/or the like, such as, but not limited to, molding, casting, machining, three dimensional (3D) printing, and/or the like. As used herein, "operatively connecting" the spring 130 to the spine 128 includes integrally forming the spring 130 and the spine 128 as a single, unitary structure. In other words, integrally forming the spring 130 and the spine 128 as a single, unitary structure is one example of a method, process, means, manner, and/or the like of operatively connecting the spring 130 to the spine 128.

Figure 12:
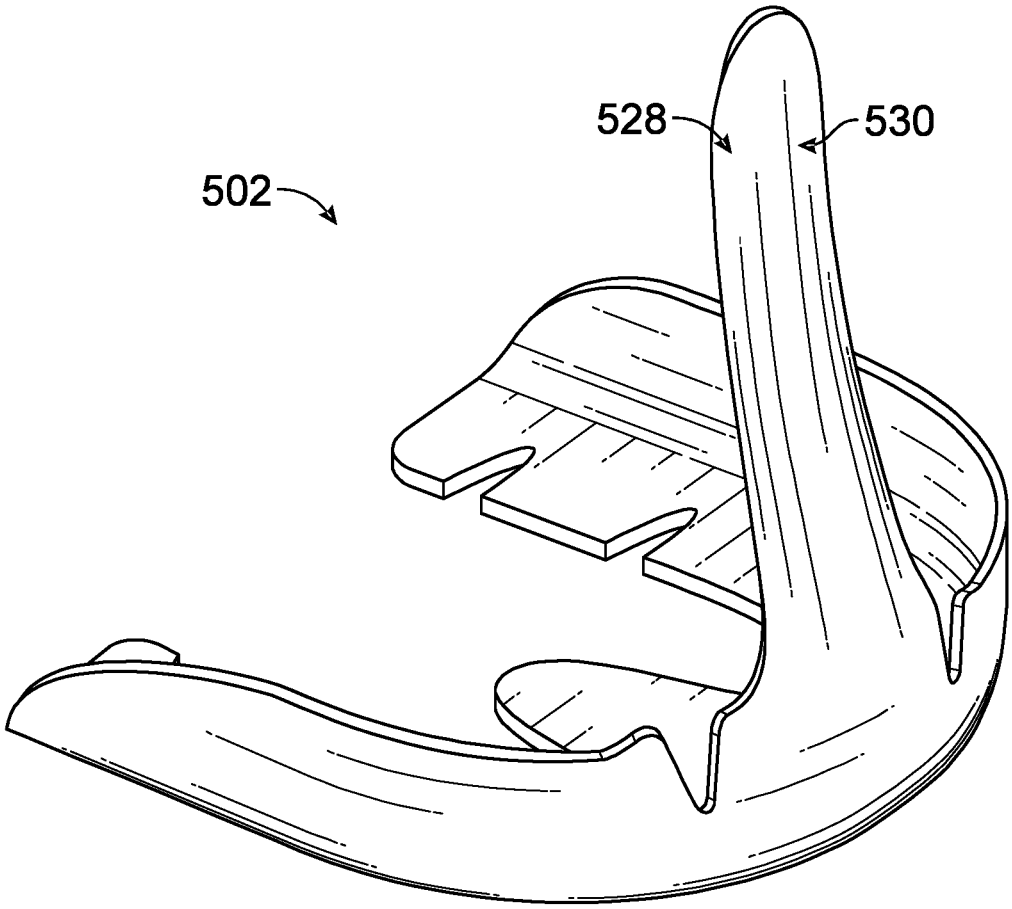
FIG. 12 is a perspective view illustrating a heel insert according to an implementation.

FIG. 12 illustrates an example implementation wherein a spring 530 and a spine 528 of a heel insert 502 are operatively connected together by being integrally formed as a single, unitary structure. In some implementations, the geometry (e.g., size, thickness, length, shape, path, etc.), material(s), and/or the like of the spring 530 and the spine 528 are selected to enable the spring 530 to function as described and/or illustrated herein (e.g., to function as described and/or illustrated herein with respect to the spring 130, to provide a spring force that configures the spine 528 to be resiliently deflectable in the direction 538, etc.)

Referring again to FIGS. 1 and 2, the geometry, material (s), and/or other variables of the various components of the heel insert 102 (e.g., the base 126, the spine 128, the spring 130, etc.) may be selected to enable the heel insert 102 to function as described and/or illustrated herein (e.g., to provide the spring 130 with a predetermined spring force, to enable an individual's foot to be received into the foot-receiving cavity 108 of the upper 106 the footwear 100 without the use of a hand and/or other tools, to provide heel counter functionality or assist the functionality of a heel counter (not shown) of the heel region 112 of the upper 106, to provide a predetermined amount of support to and/or tension against the posterior of an individual's heel, etc.). Examples of geometry, materials, and other variables that may be selected to enable (e.g., establish, tune, etc.) the heel insert 102 to function as described and/or illustrated herein include, but are not limited to: the thickness, length, width, angle relative to the base 126, shape of the path P, material composition, and/or the like of the spine 128; the thickness, length, width, shape, material composition, and/or the like of the base 126; the thickness, length, width, angle relative to the base leg 162, shape of the length, material composition, and/or the like of the spring 130; the method, process, means, manner, and/or the like of operatively connecting the spring 130 to the spine 128; and/or the like.

In operation, and referring now to FIGS. 13 and 14, the heel insert 102 enables an individual's foot to be received into the foot-receiving cavity 108 of the upper 106 of the footwear 100 without the use of a hand and/or other tools (e.g., only the individual's foot is used for successful insertion into the foot-receiving cavity, etc.). For example, using the individual's heel 178, a force F (not shown in FIG. 14) is applied to an upper end portion 184 of the posterior wall 114 of the upper 106. Against the bias provided by the spring 130, the force F resiliently deflects the spine 128 of the heel insert 102 (and thus the posterior wall 114 of the upper 106) from the first position 172 in the direction 138 toward the second position 174. Movement of the spine 128 and the posterior wall 114 in the direction 138 from the first position 172 toward the second position 174 thereby stretches (e.g., enlarges, etc.) the ankle opening 110 along the longitudinal axis 104 of the footwear 100. With the ankle opening 110 of the upper 106 stretched along the longitudinal axis 104 in the second position 174 shown in FIG. 13, the individual's foot is free to slide forward and downward into the foot-receiving cavity 108 of the upper 106 as is shown in FIG. 14. Accordingly, the heel insert 102 enables the individual's foot to be received into the foot-receiving cavity 108 of the upper 106 without the use of a hand and/or other tools. Rather, only the individual's foot is used to gain entry into the foot-receiving cavity 108 of the upper 106. The heel insert 102 thus eases foot entry into the footwear 100 by enabling hands-free foot entry.

As the individual's foot is fully received into the foot-receiving cavity 108, the stored elastic energy due to the bias of the spring 130 automatically moves the spine 128 (and thus the posterior wall 114 of the upper 106) back from the second position 174 in the direction of the arrow 186 toward the first position 172, as is illustrated in FIG. 14. In some implementations, the bias provided by the spring 130 fully returns the spine 128 and thus the posterior wall 114 to the first position 172, for example such that the spine 128 is configured to support the posterior 176 of the individual's heel 178. In other implementations, the heel insert 102 and the upper 106 are configured (e.g., sized, shaped, etc.) such that the posterior 176 of the individual's heel 178 prevents the spine 128 and posterior wall 114 from fully returning to the first position 172, for example such that the spring force of the spring 130 causes the spine 128 to provide tension against the posterior 176 of the individual's heel 178 when the footwear 100 is worn by the individual.

Figure 15:
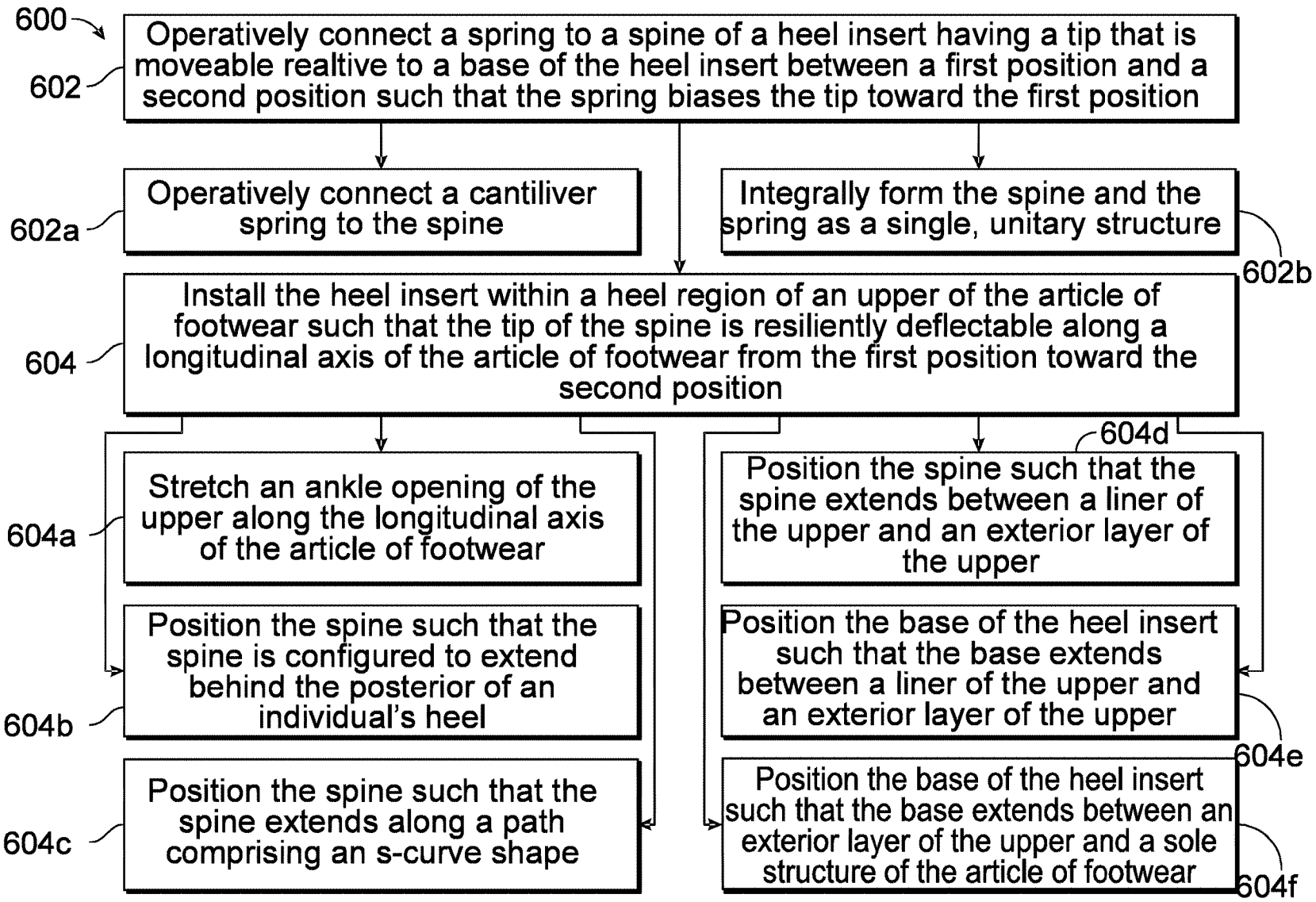
FIG. 15 is a flow chart illustrating a method for assembling an article of footwear according to an implementation.

FIG. 15 illustrates a method 600 for assembling an article of footwear (e.g., the footwear 100 shown in FIGS. 1, 5-7, 13, and 14, etc.) according to an implementation. The method 600 includes operatively connecting, at 602, a spring to a spine of a heel insert having a tip that is moveable relative to a base of the heel insert between a first position and a second position such that the spring biases the tip toward the first position. At 604, the method 600 includes installing the heel insert within a heel region of an upper of the article of footwear such that the tip of the spine is resiliently deflectable along a longitudinal axis of the article of footwear from the first position toward the second position.

In some implementations, operatively connecting at 602 the spring to the spine includes operatively connecting, at **602*a*, a cantilever spring to the spine. Optionally, operatively connecting at 602 the spring to the spine includes integrally forming, at 602***b*, the spine and the spring as a single, unitary structure.

In some implementations of the method 600, installing at 604 the heel insert within the heel region includes stretching, at 604*a*, an ankle opening of the upper along the longitudinal axis of the article of footwear.

Optionally, installing at 604 the heel insert within the heel region includes positioning, at 604*b*, the spine such that the spine is configured to extend behind the posterior of an individual's heel when the article of footwear is worn by the individual. In some implementations, installing at 604 the heel insert within the heel region includes positioning, at 604*c*, the spine such that the spine extends along a path comprising an S-curve shape. In some implementations, installing at 604 the heel insert within the heel region includes positioning, at 604*d*, the spine such that the spine extends between a liner of the upper and an exterior layer of the upper.

In some implementations, installing at 604 the heel insert within the heel region includes positioning, at 604*e*, the base of the heel insert such that the base extends between a liner of the upper and an exterior layer of the upper. Optionally, installing at 604 the heel insert within the heel region includes positioning, at 604*f*, the base of the heel insert such that the base extends between an exterior layer of the upper and a sole structure of the article of footwear.

The various implementations of heel inserts and methods disclosed herein enhance the ease of foot entry, allowing hands-free foot entry into an article of footwear.

The following clauses describe further aspects:

Clause Set A:

A1. A heel insert for an article of footwear that includes an upper defining a foot-receiving cavity having an ankle opening, the heel insert comprising:

a base configured to be operatively connected to a heel region of the upper;

a spine extending outward from the base to a tip of the spine such that the spine extends upward along a posterior wall of the heel region toward the ankle opening when the base is operatively connected to the heel region, the tip of the spine being moveable relative to the base between a first position along a longitudinal axis of the article of footwear and a second position along the longitudinal axis of the article of footwear; and a spring operatively connected to the spine such that the spring biases the tip of the spine toward the first position of the tip, the tip of the spine being resiliently deflectable toward the second position against the bias of the spring.

A2. The heel insert of any preceding clause, wherein movement of the tip of the spine from the first position toward the second position when the base is operatively connected to the heel region is configured to stretch the ankle opening of the upper of the article of footwear.

A3. The heel insert of any preceding clause, wherein the spine is configured to extend behind the posterior of an individual's heel when the article of footwear is worn by an individual.

A4. The heel insert of any preceding clause, wherein the spine extends from the base to the tip along a path comprising an S-curve shape.

A5. The heel insert of any preceding clause, wherein the spring comprises a cantilever spring.

A6. The heel insert of any preceding clause, wherein the base and the spine comprise a thermoplastic.

A7. The heel insert of any preceding clause, wherein the spring comprises at least one of a metal or carbon fiber.

A8. The heel insert of any preceding clause, wherein the base comprises a U-shape.

A9. The heel insert of any preceding claim, wherein the base comprises a U-shape, the base comprising slots extending radially outward into the base along an interior of the U-shape.

A10. The heel insert of any preceding clause, wherein the spring comprises a base leg and a spine leg, the spring being operatively connected to the spine such that the base leg extends along the base and the spine leg extends along the spine.

A11. The heel insert of any preceding clause, wherein the spine extends between a liner of the upper and an exterior layer of the upper when the base is operatively connected to the heel region of the upper.

A12. The heel insert of any preceding clause, wherein the base extends between a liner of the upper and an exterior layer of the upper when the base is operatively connected to the heel region of the upper.

A13. The heel insert of any preceding clause, wherein the base extends between an exterior layer of the upper and a sole structure of the article of footwear when the base is operatively connected to the heel region of the upper.

A14. The heel insert of any preceding clause, wherein the spine extends outward from the base to the tip along a path having a shape that is complementary with a shape of the posterior wall of the heel region of the upper.

A15. The heel insert of any preceding clause, wherein the spring and the spine are integrally formed as a single, unitary structure.

A16. The heel insert of any preceding clause, wherein the spring is connected to at least one of the base or the spine.

A17. The heel insert of any preceding clause, wherein the base and the spine are integrally formed as a single, unitary structure.

Clause set B:

B1. An article of footwear comprising:

an upper extending a length along a longitudinal axis of the article of footwear, the upper defining a foot-receiving cavity having an ankle opening, the upper comprising a heel region having a posterior wall; and a heel insert comprising:

a base operatively connected to the heel region of the upper;

a spine extending outward from the base to a tip of the spine such that the spine extends upward along the posterior wall of the heel region toward the ankle opening, the tip of the spine being moveable relative to the base between a first position along the longitudinal axis of the article of footwear and a second position along the longitudinal axis of the article of footwear; and a spring operatively connected to the spine such that the spring biases the tip of the spine toward the first position of the tip, the tip of the spine being resiliently deflectable toward the second position against the bias of the spring.

B2. The article of footwear of any preceding clause, wherein movement of the tip of the spine from the first position toward the second position is configured to stretch the ankle opening of the upper.

B3. The article of footwear of any preceding clause, wherein the spine is configured to extend behind the posterior of an individual's heel when the article of footwear is worn by an individual.

B4. The article of footwear any preceding clause, wherein the spine extends from the base to the tip along a path comprising an S-curve shape.

B5. The article of footwear of any preceding clause, wherein the spring comprises a cantilever spring.

B6. The article of footwear any preceding clause, wherein the base and the spine comprise a thermoplastic, the spring comprising at least one of a metal or carbon fiber.

B7. The article of footwear any preceding clause, wherein the base comprises a U-shape, the base comprising slots extending radially outward into the base along an interior of the U-shape.

B8. The article of footwear any preceding clause, wherein the spring comprises a base leg and a spine leg, the spring being operatively connected to the spine such that the base leg extends along the base and the spine leg extends along the spine.

B9. The article of footwear any preceding clause, wherein the base is operatively connected to the heel region of the upper such that the spine extends between a liner of the upper and an exterior layer of the upper.

B10. The article of footwear any preceding clause, wherein the base is operatively connected to the heel region of the upper such that the base extends between a liner of the upper and an exterior layer of the upper.

B11. The article of footwear any preceding clause, wherein the base is operatively connected to the heel region of the upper such that the base extends between an exterior layer of the upper and a sole structure of the article of footwear.

B12. The article of footwear any preceding clause, wherein the spine extends outward from the base to the tip along a path having a shape that is complementary with a shape of the posterior wall of the heel region of the upper.

B13. The article of footwear any preceding clause, wherein the spring and the spine are integrally formed as a single, unitary structure.

B14. The article of footwear any preceding clause, wherein the upper comprises a stretch point that is configured to enable an end of the posterior wall of the heel region of the upper to move along the longitudinal axis of the article of footwear.

Clause set C:

C1. A method for assembling an article of footwear, the method comprising:

operatively connecting a spring to a spine of a heel insert having a tip that is moveable relative to a base of the heel insert between a first position and a second position such that the spring biases the tip toward the first position; and installing the heel insert within a heel region of an upper of the article of footwear such that the tip of the spine is resiliently deflectable along a longitudinal axis of the article of footwear from the first position toward the second position.

C2. The method of any preceding clause, wherein installing the heel insert within the heel region comprises stretching an ankle opening of the upper along the longitudinal axis of the article of footwear.

C3. The method of any preceding clause, wherein installing the heel insert within the heel region comprises positioning the spine such that the spine is configured to extend behind the posterior of an individual's heel when the article of footwear is worn by an individual.

C4. The method of any preceding clause, wherein installing the heel insert within the heel region comprises positioning the spine such that the spine extends along a path comprising an S-curve shape.

C5. The method of any preceding clause, wherein operatively connecting the spring to the spine comprises operatively connecting a cantilever spring to the spine.

C6. The method of any preceding clause, wherein installing the heel insert within the heel region comprises positioning the spine such that the spine extends between a liner of the upper and an exterior layer of the upper.

C7. The method of any preceding clause, wherein installing the heel insert within the heel region comprises positioning the base of the heel insert such that the base extends between a liner of the upper and an exterior layer of the upper.

C8. The method of any preceding clause, wherein installing the heel insert within the heel region comprises positioning the base of the heel insert such that the base extends between an exterior layer of the upper and a sole structure of the article of footwear.

C9. The method of any preceding clause, wherein operatively connecting the spring to the spine comprises integrally forming the spine and the spring as a single, unitary structure.

As used herein, a structure, limitation, or element that is "configured to" perform a task or operation is particularly structurally formed, constructed, or adapted in a manner corresponding to the task or operation. For purposes of clarity and the avoidance of doubt, an object that is merely capable of being modified to perform the task or operation is not "configured to" perform the task or operation as used herein.

Any range or value given herein can be extended or altered without losing the effect sought, as will be apparent to the skilled person.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

It will be understood that the benefits and advantages described above can relate to one implementation or can relate to several implementations. The implementations are not limited to those that solve any or all of the stated problems or those that have any or all of the stated benefits and advantages. It will further be understood that reference to 'an' item refers to one or more of those items.

The order of execution or performance of the operations in examples of the present application illustrated and described herein is not essential, unless otherwise specified. That is, the operations can be performed in any order, unless otherwise specified, and examples of the application can include additional or fewer operations than those disclosed herein. For example, it is contemplated that executing or performing a particular operation before, contemporaneously with, or after another operation (e.g., different steps, etc.) is within the scope of aspects and implementations of the application.

The term "comprising" is used in this specification to mean including the feature(s) or act(s) followed thereafter, without excluding the presence of one or more additional features or acts. The terms "comprising," "including," and "having" are intended to be inclusive and mean that there can be additional elements other than the listed elements. In other words, the use of "including," "comprising," "having," "containing," "involving," and variations thereof, is meant to encompass the items listed thereafter and additional items. Further, references to "one implementation" are not intended to be interpreted as excluding the existence of additional implementations that also incorporate the recited features. The term "exemplary" is intended to mean "an example of".

When introducing elements of aspects of the application or the examples thereof, the articles "a," "an," "the," and "said" are intended to mean that there are one or more of the elements. In other words, the indefinite articles "a", "an", "the", and "said" as used in the specification and in the claims, unless clearly indicated to the contrary, should be understood to mean "at least one."

The phrase "one or more of the following: A, B, and C" means "at least one of A and/or at least one of B and/or at least one of C." The phrase "and/or", as used in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one implementation, to A only (optionally including elements other than B); in another implementation, to B only (optionally including elements other than A); in yet another implementation, to both A and B (optionally including other elements); etc.

As used in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of or "exactly one of," or, when used in the claims, "consisting of," will refer to the inclusion of exactly one element of a number or list of elements. In general, the term "or" as used shall only be interpreted as indicating exclusive alternatives (i.e. "one or the other but not both") when preceded by terms of exclusivity, such as "either," "one of" "only one of" or "exactly one of." "Consisting essentially of," when used in the claims, shall have its ordinary meaning as used in the field of patent law.

As used in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one implementation, to at least one, optionally including more than one, A, with no B present (and optionally including elements other than B); in another implementation, to at least one, optionally including more than one, B, with no A present (and optionally including elements other than A); in yet another implementation, to at least one, optionally including more than one, A, and at least one, optionally including more than one, B (and optionally including other elements); etc.

Use of ordinal terms such as "first," "second," "third," etc., in the claims to modify a claim element does not by itself connote any priority, precedence, or order of one claim element over another or the temporal order in which acts of a method are performed. Ordinal terms are used merely as labels to distinguish one claim element having a certain name from another element having a same name (but for use of the ordinal term), to distinguish the claim elements.

Having described aspects of the application in detail, it will be apparent that modifications and variations are possible without departing from the scope of aspects of the application as defined in the appended claims. As various changes could be made in the above constructions, products, and methods without departing from the scope of aspects of the application, it is intended that all matter contained in the above description and shown in the accompanying drawings shall be interpreted as illustrative and not in a limiting sense.

It is to be understood that the above description is intended to be illustrative, and not restrictive. For example, the above-described implementations (and/or aspects thereof) can be used in combination with each other. In addition, many modifications can be made to adapt a particular situation or material to the teachings of the various implementations of the application without departing from their scope. While the dimensions and types of materials described herein are intended to define the parameters of the various implementations of the application, the implementations are by no means limiting and are example implementations. Many other implementations will be apparent to those of ordinary skill in the art upon reviewing the above description. The scope of the various implementations of the application should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

This written description uses examples to disclose the various implementations of the application, including the best mode, and also to enable any person of ordinary skill in the art to practice the various implementations of the application, including making and using any devices or systems and performing any incorporated methods. The patentable scope of the various implementations of the application is defined by the claims, and can include other examples that occur to those persons of ordinary skill in the art. Such other examples are intended to be within the scope of the claims if the examples have structural elements that do not differ from the literal language of the claims, or if the examples include equivalent structural elements with insubstantial differences from the literal language of the claims.

What is claimed is:

1. A heel insert for an article of footwear, the heel insert comprising:

a base configured to be operatively connected to a heel region of an upper of the article of footwear;

a spine extending vertically outward from the base to a tip of the spine such that the spine extends vertically upward along a posterior wall of the heel region toward an ankle opening of the article of footwear when the base is operatively connected to the heel region, the tip of the spine being moveable along a longitudinal axis between a first angle position relative to the base and a second different angle position relative to the base; and a spring operatively connected to the spine such that the spring biases the tip of the spine toward the first angle position of the tip relative to the base, the tip of the spine being resiliently deflectable toward the second different angle position against the bias of the spring.

2. The heel insert of claim 1, wherein movement of the tip of the spine from the first angle position toward the second different angle position when the base is operatively connected to the heel region is configured to stretch the ankle opening of the upper of the article of footwear along the longitudinal axis of the article of footwear.

3. The heel insert of claim 1, wherein the spine is configured to extend behind a posterior of an individual's heel when the article of footwear is worn by an individual.

4. The heel insert of claim 1, wherein the spine extends from the base to the tip along a path comprising offsetting curves along a length of the spine to create a spring-like structure that enables the spine to act as a shock absorber.

5. The heel insert of claim 1, wherein the spring comprises a cantilever spring.

6. The heel insert of claim 1, wherein the base comprises a U-shape, the base comprising slots extending radially outward into the base along an interior of the U-shape.

7. The heel insert of claim 1, wherein the spine is configured to extend between a liner of the upper and an exterior layer of the upper when the base is operatively connected to the heel region of the upper.

8. The heel insert of claim 1, wherein the base is configured to extend between a liner of the upper and an exterior layer of the upper when the base is operatively connected to the heel region of the upper.

9. The heel insert of claim 1, wherein the base is configured to extend between an exterior layer of the upper and a sole structure of the article of footwear when the base is operatively connected to the heel region of the upper.

10. The heel insert of claim 1, wherein the spring is connected to at least one of the base or the spine.

11. An apparatus comprising:

a U-shaped base configured to be operatively connected to a heel region of an upper of an article of footwear;

a spine extending vertically upward from the U-shaped base to a tip of the spine along a posterior wall of the heel region toward an ankle opening of the article of footwear when the U-shaped base is operatively connected to the heel region, the spine comprising offsetting curves along a length of the spine; and a spring operatively connected to the spine such that the spring biases the tip of the spine toward a first angle position of the tip relative to the base, the tip of the spine being resiliently deflectable toward a second different angle position against the bias of the spring.

12. The apparatus of claim 11, wherein movement of the tip of the spine from the first angle position toward the second different angle position when the base is operatively connected to the heel region stretches the ankle opening of the article of footwear along a longitudinal axis of the article of footwear.

13. The apparatus of claim 11, wherein the spine is configured to extend behind a posterior of an individual's heel when the article of footwear is worn by an individual.

14. The apparatus of claim 11, wherein the tip of the spine is moveable along a longitudinal axis between the first angle position and the second different angle position.

15. The apparatus of claim 11, wherein the spring further comprises:

a spine leg; and a base leg, wherein the base leg is connected to an extension of the U-shaped base.

16. The apparatus of claim 11, wherein the U-shape base further comprises a plurality of slots extending radially outward into the U-shaped base along an interior of the U-shaped base.

17. The apparatus of claim 11, wherein the spine is configured to extend between a liner of the upper and an exterior layer of the upper when the U-shaped base is operatively connected to the heel region of the upper.

18. The apparatus of claim 11, wherein the U-shaped base is configured to extend between a liner of the upper and an exterior layer of the upper when the base is operatively connected to the heel region of the upper.

19. The apparatus of claim 11, wherein the U-shaped base is configured to extend between an exterior layer of the upper and a sole structure of the article of footwear when the base is operatively connected to the heel region of the upper.

20. A heel insert comprising:

a U-shaped base configured to be operatively connected to a heel region of an upper of an article of footwear;

a spine extending vertically upward from the U-shaped base to a tip of the spine along a posterior wall of the heel region toward an ankle opening of the article of footwear when the U-shaped base is operatively connected to the heel region, the spine comprising offsetting curves along a length of the spine, the spine being moveable along a longitudinal axis between a first angle position relative to the U-shaped base and a second different angle position relative to the U-shaped base, the second different angle position configured to stretch the ankle opening of the article of footwear along the longitudinal axis of the article of footwear; and a spring operatively connected to the spine such that the spring biases the tip of the spine toward the first angle position of the tip relative to the base, the tip of the spine being resiliently deflectable toward the second different angle position against the bias of the spring.

* * * * *